US011608258B2

(12) United States Patent
Jenkins

(10) Patent No.: US 11,608,258 B2
(45) Date of Patent: Mar. 21, 2023

(54) MULTI-PURPOSE HYDRATION STATION

(71) Applicant: Shanette Jenkins, Washington, DC (US)

(72) Inventor: Shanette Jenkins, Washington, DC (US)

( * ) Notice: Subject to any disclaimer, the term of this patent is extended or adjusted under 35 U.S.C. 154(b) by 0 days.

(21) Appl. No.: 17/351,834

(22) Filed: Jun. 18, 2021

(65) Prior Publication Data

US 2022/0242714 A1 Aug. 4, 2022

Related U.S. Application Data

(60) Provisional application No. 63/144,851, filed on Feb. 2, 2021.

(51) Int. Cl.

| | |
|---|---|
| ***B67D 1/00*** | (2006.01) |
| ***B67D 1/08*** | (2006.01) |
| ***B67D 1/10*** | (2006.01) |
| ***F25C 1/00*** | (2006.01) |

(52) U.S. Cl.

CPC ..... *B67D 1/0014* (2013.01); *B67D 1/0857* (2013.01); *B67D 1/0875* (2013.01); *B67D 1/0878* (2013.01); *B67D 1/0888* (2013.01); *B67D 1/10* (2013.01); *F25C 1/00* (2013.01); *B67D 2210/0001* (2013.01)

(58) Field of Classification Search

CPC .. B67D 1/0014; B67D 1/0857; B67D 1/0875; B67D 1/0878; B67D 1/0888; B67D 1/10; B67D 2210/0001; F25C 1/00

See application file for complete search history.

(56) References Cited

U.S. PATENT DOCUMENTS

| | | | | |
|---|---|---|---|---|
| 2010/0242497 | A1* | 9/2010 | Bertone | B67D 1/1236 62/344 |
| 2013/0180267 | A1* | 7/2013 | Hartig | F25B 7/00 62/340 |
| 2014/0239521 | A1* | 8/2014 | Ergican | B01F 23/2323 261/DIG. 1 |
| 2014/0270725 | A1* | 9/2014 | Bertolini | F25D 23/04 392/341 |
| 2016/0107874 | A1* | 4/2016 | Wang | B67D 3/0022 222/144.5 |
| 2020/0029725 | A1* | 1/2020 | Wantland | F25D 23/126 |

* cited by examiner

*Primary Examiner* — Donnell A Long
(74) *Attorney, Agent, or Firm* — Brennan, Manna & Diamond, LLC

(57) ABSTRACT

The present invention relates to a multi-purpose hydration station for dispensing different kinds of beverages, soft ice, ice, hot water and non-heated water. More specifically, the multi-purpose hydration station features a hot water dispenser unit, a non-heated water dispenser unit, a beverage dispenser unit, a soft ice dispenser unit and an ice maker for dispensing the user's requested item and eliminates the need to use separate dispensing machines to dispense different kinds of beverages or items. Additionally, the hydration station features a refrigeration and a non-refrigeration storage area to allow the users to store their items as per their requirements. The hydration station offers a convenient solution for setting up a hydration station that saves space, energy and expenses of the user.

18 Claims, 4 Drawing Sheets

MULTI-PURPOSE HYDRATION STATION

CROSS-REFERENCE TO RELATED APPLICATION

The present application claims priority to, and the benefit of, U.S. Provisional Application No. 63/144,851, which was filed on Feb. 2, 2021 and is incorporated herein by reference in its entirety.

FIELD OF THE INVENTION

The present invention relates to the field of beverage dispensing machines. More specifically, the present invention relates to a multi-purpose beverage dispenser that is a bottom-loading water and beverage dispenser comprising a hot water dispenser, a non-heated water dispenser, a coffee dispenser, a tea dispenser, a filtering device, a soft ice dispenser and an ice dispenser. Accordingly, the present disclosure makes specific reference thereto. Nonetheless, it is to be appreciated that aspects of the present invention are also equally applicable to other like applications, devices and methods of manufacture.

BACKGROUND OF THE INVENTION

Water stations are often used in offices, homes, restaurants and other similar places for storing and quickly dispensing water to users. Other devices, such as beverage dispensers, are also used in these locations to easily dispense beverages, such as tea or coffee. This plurality of devices is sometimes called a "hydration station." Generally, different devices in a hydration station are used to dispense hot water and non-heated water. In a similar manner, different dispensing machines are required to dispense a multitude of beverages such as tea, coffee and others. Owners may be required to buy and set up multiple dispensing machines to create a hydration station that fulfils the needs and desires of all users. However, buying separate dispensing machines to fulfil different needs can be expensive for owners. Additionally, multiple dispensing machines require more space than a single machine with multiple purposes. Effort and space may be wasted by setting up separate dispensing machines to dispense different kinds of beverages. Also, users may desire to store coffee pods, tea bags and other similar items near the hydration station. Currently available dispensers do not provide storage space to store these small-sized items that occupy unnecessary space near the dispensers.

Additionally, at restaurants, ice makers and soft ice dispensers are frequently used and a different machine is required for dispensing each of them. Again, this adds to the expense of restaurant owners. Also, multiple dispensing machines occupy more space and require more energy to operate.

Therefore, there exists a long-felt need in the art for a filtration and dispensing machine that dispenses hot water, non-heated water, tea, coffee, soft ice and ice. Additionally, there is a long-felt need in the art for a multi-purpose dispensing machine that eliminates the need to buy separate filtration and dispensing machines for filtering and dispensing different items, such as non-heated water, hot water, coffee, tea, soft ice and ice. Moreover, there is a long-felt need in the art for a multi-purpose dispensing machine that is compact and eliminates the need to set up multiple dispensing machines at a hydration station. Further, there is a long-felt need in the art for a multi-purpose dispensing machine that is cost-effective and saves energy. Finally, there is a long-felt need in the art for a dispensing machine that offers a simple and convenient method to obtain a beverage while at home, an office, a restaurant or other similar places.

The subject matter disclosed and claimed herein, in one embodiment of the present invention, comprises a multi-functional hydration station. The hydration station is configured for use in homes, offices, restaurants and public spaces. The hydration station further comprises a bottom loading a water container for providing water for beverages, an ice maker unit for making ice using water from water container, a heating unit for heating water, a soft ice maker for making soft ice using a coupled refrigeration unit and a beverage maker for making a beverage using a beverage pod. The water container features a filtration cartridge to filter the water and is in fluid communication with the other units. More specifically, the hydration station comprises a dispensing system including a non-heated water dispenser for dispensing non-heated water, a heated water dispenser for dispensing heated water from the heating unit, a soft ice dispenser for dispensing soft ice from the soft ice maker, a beverage dispenser for dispensing a beverage from the beverage maker and an ice dispenser for dispensing ice produced by the ice maker. In addition to the mentioned components, the hydration station features a refrigeration storage area and a non-refrigeration storage area for storing different items.

In this manner, the novel multi-purpose beverage dispenser of the present invention accomplishes all the forgoing objectives and provides an easy, convenient and cost-effective solution for dispensing different kinds of beverages and other items to users. The multi-purpose beverage dispenser of the present invention is easier to set up and occupies less space than conventional hydration stations that have multiple dispensing machines. The multi-purpose beverage dispenser saves energy and provides a better solution for dispensing different kinds of beverages, water variants, ice, soft ice, etc. using an individual dispensing machine, thereby reducing the users' costs.

SUMMARY OF THE INVENTION

The following presents a simplified summary in order to provide a basic understanding of some aspects of the disclosed innovation. This summary is not an extensive overview and it is not intended to identify critical elements or to limit the scope of this disclosure. The sole purpose of this summary is to present some general concepts in a simplified form as a prelude to the detailed description of the invention.

The subject matter disclosed and claimed herein, in one embodiment thereof, comprises a multifunctional hydration station. The hydration station is configured for use in homes, offices, restaurants and public spaces. The hydration station further comprises a bottom loading water container for providing water for beverages, an ice maker unit for making ice using water from the water container, a heating unit for heating water, a soft ice maker for making soft ice using a coupled refrigeration unit and a beverage maker for making a beverage using a beverage pod. The water container includes a filtration cartridge to filter the water and is fluidly connected to the other units. The hydration station also comprises a dispensing system including a non-heated water dispenser for dispensing non-heated water, a heated water dispenser for dispensing heated water from the heating unit, a soft ice dispenser for dispensing soft ice from the soft ice maker, a beverage dispenser for dispensing a beverage from the beverage maker and an ice dispenser for dispensing ice produced by the ice maker.

In a further embodiment of the present invention, a dispensing device for dispensing beverages, hot water, non-heated water, ice and soft ice is disclosed. The dispensing device is further configured to receive a plurality of single use pods into a pod compartment or tray for producing a hot or cold beverage. The dispensing device includes a beverage maker for producing the hot or cold beverage using the single use pods and said beverage is dispensed through a beverage dispenser; an ice maker produces and fragments ice to be dispensed through an ice dispenser, a soft ice maker produce soft ice with flavoring agents and is dispensed through a soft ice dispenser, and a heated and non-heated water dispenser. A water container is present at the bottom of the dispensing device and is fluidly connected to the other units for supplying filtered water.

In a further embodiment of the present invention, the dispensing device includes a non-refrigeration storage compartment for pods, teas bags, coffee and more. The dispensing device also includes a refrigeration storage compartment for storing cold items. The bottom loading water container is covered by an aesthetically appealing lid and may save space by eliminating the need for multiple appliances while also providing storage and saving energy.

In a further embodiment of the present invention, the beverage dispenser has a plurality of touch buttons to request one or more beverages, soft ice, hot water, non-heated water and ice. A controller sends an instruction to a unit to dispense the content as per the requirement of a user, wherein the controller also senses if a cup or a container is placed on a platform below the dispensing nozzles of the dispenser to allow dispensing of the beverages or water. Only the soft ice dispenser and ice dispenser are active in such cases.

In yet a further embodiment of the present invention, the ice maker unit can have a fragmentation unit. A single use or reusable pod may be used for making a hot or cold beverage by mixing the pod contents with the water in a beverage maker. The device of the present invention can further comprise a holder to hold or store a stack of single use or re-usable cups from which a single cup can be easily retrieved by a user.

To the accomplishment of the foregoing and related ends, certain illustrative aspects of the disclosed innovation are described herein in connection with the following description and the annexed drawings. These aspects are indicative of only a few of the various ways in which the principles disclosed herein can be employed and are intended to include all such aspects and their equivalents. Other advantages and novel features will become apparent from the following detailed description when considered in conjunction with the drawings.

BRIEF DESCRIPTION OF THE DRAWINGS

The description refers to provided drawings in which similar reference characters refer to similar parts throughout the different views, and in which.

DETAILED DESCRIPTION OF THE INVENTION

Figure 1:
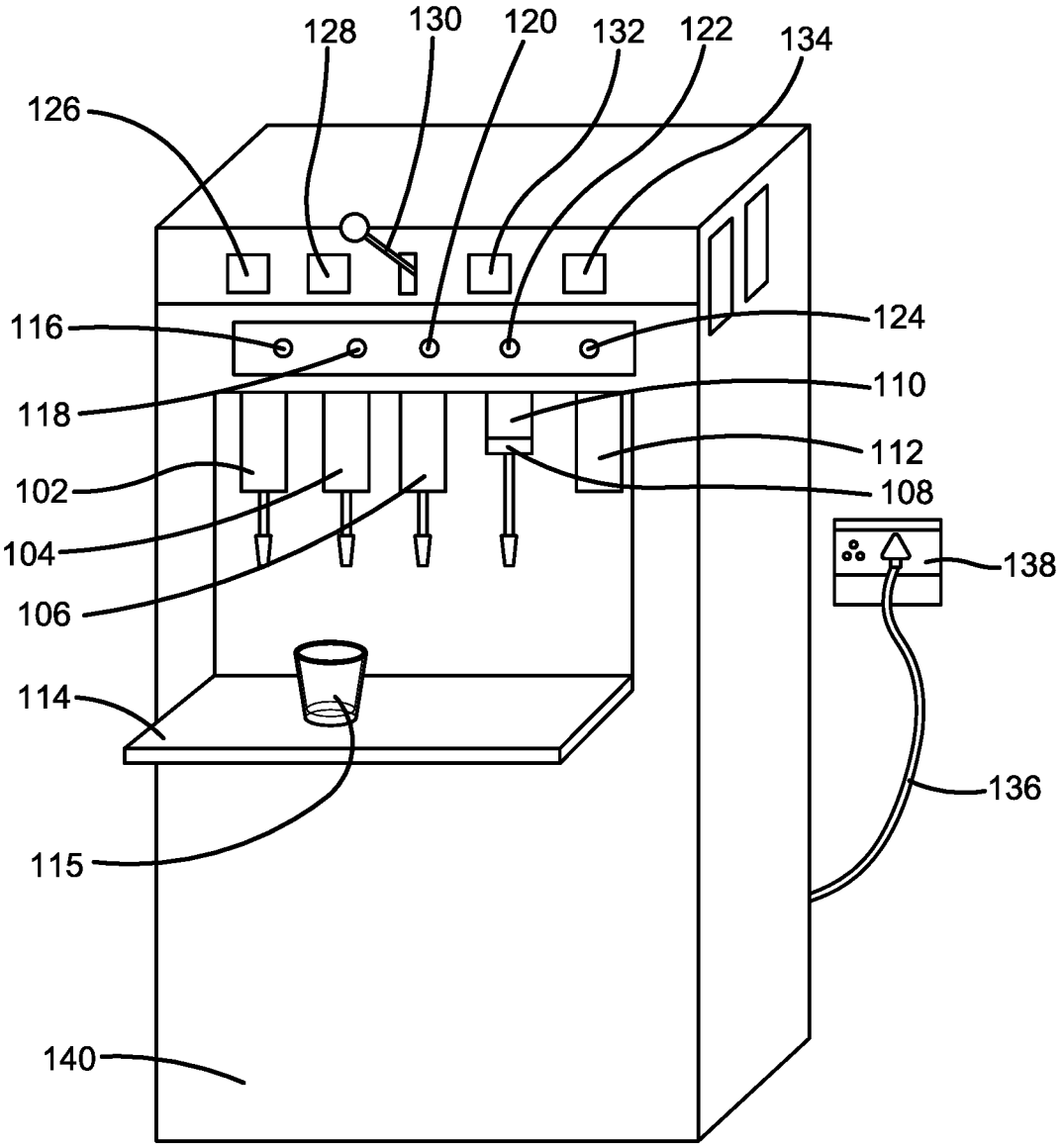
FIG. 1 illustrates a perspective view of one potential embodiment of the multi-purpose hydration station of the present invention in accordance with the disclosed architecture.

The innovation is now described with reference to the drawings, wherein reference numerals are used to refer to elements throughout. In the following description, for purposes of explanation, numerous specific details are set forth to provide a thorough understanding of the present invention. It may be evident that the innovation can be practiced without these specific details. In other instances, well-known structures and devices are shown in block diagram form in order to facilitate a description thereof. Various embodiments are discussed hereinafter. It should be noted that the figures are described only to facilitate the description of the embodiments. They are not intended as an exhaustive description of the invention and do not limit the scope of the invention. Additionally, an illustrated embodiment need not have all the aspects or advantages shown. Thus, in other embodiments, any of the features described herein from different embodiments may be combined.

As noted above, there exists a long-felt need in the art for a dispensing machine that allows a user to dispense hot water and non-heated water, per the user's desire. There is also a long-felt need in the art for a single dispensing machine that can dispense tea, coffee, soft ice or ice. Additionally, there is a long-felt need in the art for a multi-purpose dispensing machine that eliminates the need to buy separate dispensing machines for dispensing different items such as non-heated water, hot water, coffee, tea, soft ice and ice. Moreover, there is a long-felt need in the art for a multi-purpose dispensing machine that is compact and eliminates the need to set up multiple dispensing machines at a target location. Further, there is a long-felt need in the art for a dispensing machine that reduces the effort of users who currently must set up multiple machines to dispense different kinds of beverages. Furthermore, there is a long-felt need in the art for a multi-purpose dispensing machine that is cost-effective and saves energy. Finally, there is a long-felt need in the art for a dispensing machine that offers a simple and convenient method to obtain a beverage while at home, an office, a restaurant or other similar places.

In one embodiment, the present invention is a novel dispensing device for dispensing beverages, hot water, non-heated water, ice and soft ice. The dispensing device is further configured to receive a plurality of single use pods into a pod compartment or tray for producing a hot or cold beverage. The dispensing device includes a beverage maker for producing a hot or cold beverage using single use pods and said beverage being dispensed through a beverage dispenser, an ice maker to produce and fragment ice to be dispensed through an ice dispenser, a soft ice maker to produce soft ice with flavoring agents that is dispensed through a soft ice dispenser, a heated water dispenser and non-heated water dispenser. Additionally, the dispensing device allows the users to dispense hot or non-heated water.

Referring to the drawings, FIG. 1 illustrates a perspective view of one potential embodiment of the multi-purpose hydration station 100 of the present invention in accordance with the disclosed architecture. More specifically, the multi-purpose hydration station 100 of the present invention is preferably generally rectangular in shape, and is also portable, compact and lightweight. The hydration station 100 dispenses a variety of beverages, hot and non-heated water, soft ice and ice. The hydration station 100 is ideal for homes, offices, public spaces, restaurants, bars and other recreational places. Further, the hydration station 100 includes a plurality of functions, thereby replacing a variety of appliances. The hydration station 100 has refrigeration and non-refrigeration storage space allowing users to store food and other items.

The hydration unit 100 has a controller that dispenses a particular drink requested by a user as per an input selected on the hydration unit 100. In various embodiments, the hydration unit 100 can produce and dispense soft ice, shaved or crushed ice and beverages using beverage pods. The drinks that can also be dispensed by the hydration station 100 are non-heated water, heated water and a beverage having a coffee or coffee-like taste (e.g., espresso, French vanilla, mocha) using a single use pod. The hydration station 100 has different dispensers for different types of beverages.

The hydration station 100 has a plurality of dispenser units for dispensing different types of beverages and drinks. A non-heated water dispenser 102 is used for dispensing non-heated water and can be operated using a non-heated water control button 126. An LED 116 blinks when the non-heated water is dispensed from the dispenser unit 102. A water source such as a water can or container is present within a storage area 140 of the hydration station 100, and water from the water source is retrieved using a source pump for dispensing water or other items.

A heated water dispenser 104 is used for dispensing heated water and can be operated using a heated water control button 128. A second LED 118 blinks when the heated water is dispensed from the heated dispenser unit 104. The water is heated using an inbuilt water heater unit for heating water pumped from the water can or container.

A soft ice dispenser 106 is used for dispensing soft ice and can be operated using a soft ice control handle 130. A third LED 120 radiates when the soft ice is dispensed from the soft ice dispenser 106. To prepare the soft ice, ice from an ice maker is used and the soft ice can be used as a standalone refreshment or to cool a beverage. Alternatively, the soft ice can be mixed with a flavor and milk from a milk storage container. The soft ice is frozen and prepared when requested by a user using the ice control handle 130.

A hot beverage dispenser 108 is used for dispensing a beverage such as coffee or tea. A beverage flavoring unit, such as a coffee or tea pod, can be fitted in a tray 110 and the hot beverage dispenser 108 can use the fitted coffee or tea pod for dispensing the coffee or tea from the dispenser 108. A control button 132 is pressed for requesting the tea or coffee and a corresponding LED light 122 indicates the hot beverage dispenser 108 is in operation and the desired beverage is being dispensed.

Ice prepared by the ice maker is dispensed in one or more of the forms including crushed ice, large chunks of ice or small cubes of ice formed from the ice dispensing unit 112. The ice maker is integrated within the hydration station 100 and is configured to prepare and supply ice in a quantity sufficient to produce soft ice and dispense crushed ice through an ice-dispensing point. The ice maker has a refrigeration unit with a thermally-insulated exterior surface to produce and supply crushed ice. Alternatively, the hydration unit 100 can supply ice cubes, such as larger blocks or chunks. A control button 134 can be present to produce and dispense ice from the ice dispensing unit. A corresponding LED light 124 indicates the ice dispensing unit 112 is in operation and ice is being dispensed.

The grouping of the control buttons 126, 128, 132, 134, and the control handle 130 constitute one embodiment of a selection interface. A platform 114 extends outward from the body of the hydration station 100 allowing a glass 115 or a tumbler to be placed for receiving the beverage or water dispensed from the unit 100. The hydration station 100 has a power cord 136 to receive power from an ordinary power outlet 138.

In one embodiment of the present invention, the hydration station 100 can dispense frozen beverages allowing the crushed ice produced by the ice maker to mix with water or beverages, and a flavoring agent within an inbuilt mixer. For producing non-heated water and soft ice, some of the ice produced by the icemaker is stored in an ice repository for instant use.

In some embodiments, the LED lights of the hydration station 100 can flash in red color to indicate a problem with the corresponding dispenser unit. Also, the LED lights of some embodiments of the hydration station 100 can flash or blink in a green or blue color, when the corresponding dispenser unit is in operation. In additional embodiments, the LEDs can flash in any color to indicate working or malfunctioning of the corresponding dispensing unit. The use of colors for LEDs is not limited and can be set as per the desires of the users.

To produce coffee, tea or any other drink, an operator or user places one or more pods that contain a full quantity of beverage in the pod tray 110. The new pod pouch is positioned within the tray 110 such that on activating the beverage dispenser 108 using the control button 132. In case a pod is not present, the LED indicator 122 flashes in a different color such as red, to indicate that the pod tray 110 is empty. The control buttons for activating the dispensing mechanisms for the beverages or ice can be physical buttons or touch buttons.

Figure 2:
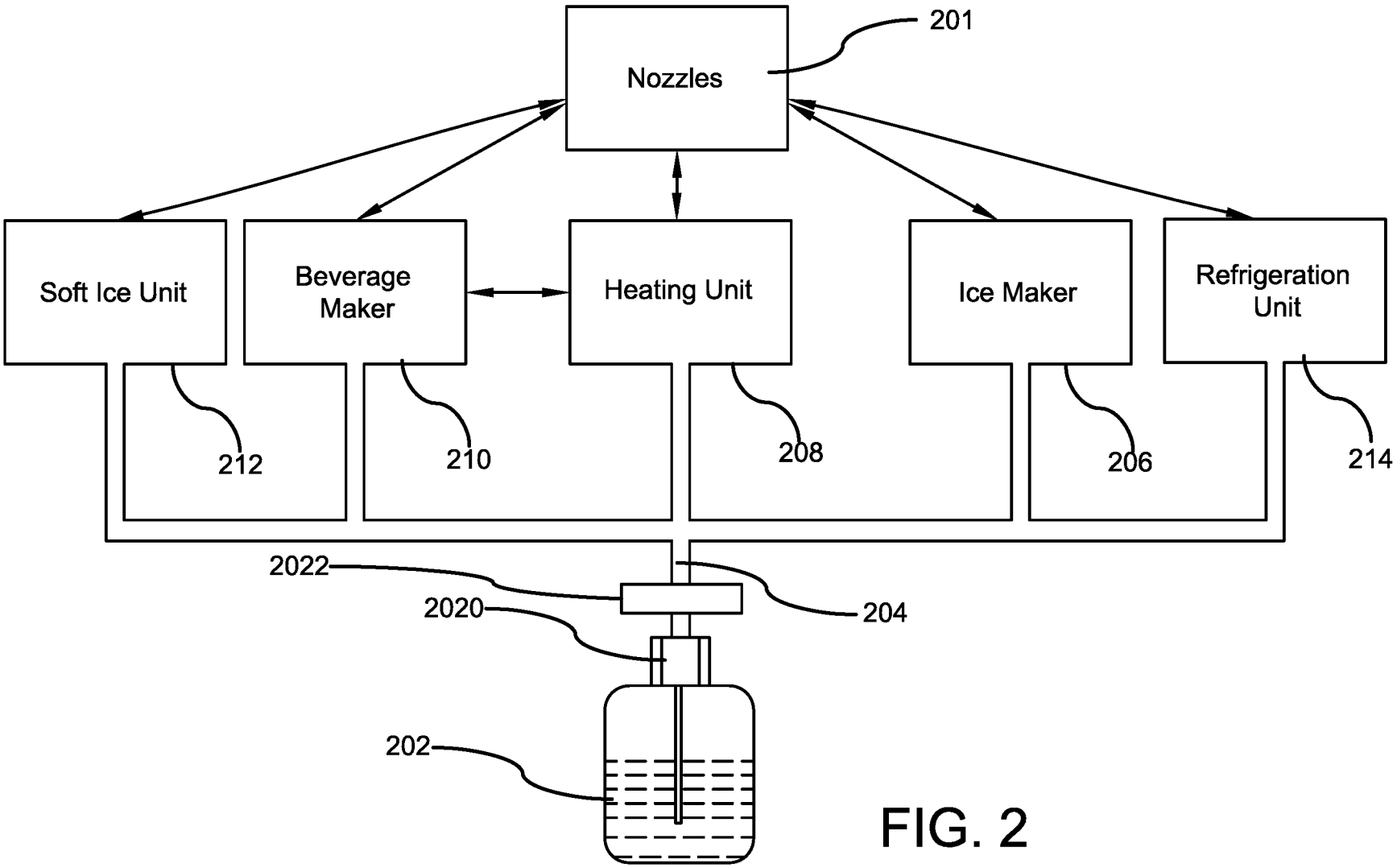
FIG. 2 illustrates a diagrammatic view of the interconnectability of the various components of one potential embodiment of the multi-purpose hydration station of the present invention in accordance with the disclosed architecture.

FIG. 2 illustrates a diagrammatic view of the interconnectability of the various components of one potential embodiment of the multi-purpose hydration station 100 of the present invention in accordance with the disclosed architecture. More specifically, the hydration station 100 is bottom loading with a water source or container 202 placed in a storage area at the bottom of the hydration station 100. A suction pump 2020 is fitted at the head of the water container 202, allowing the water to move up through a conduit 204 to be used for dispensing through the dispensing nozzles or units 201. The conduit 204 is divided in order to supply water to different units or modules of 206, 208, 210, 212, 214 of the hydration station 100. Preferably, water that is pumped from the water container 202 is first pumped through an integrated filter 2022 and then is passed through the conduit 204.

An ice maker 206 is integrated within the hydration station 100 and is configured to prepare and supply ice. The ice maker 206 has a refrigeration unit with a thermally insulated exterior surface to produce and supply crushed ice. The ice maker 206 receives water through the conduit 204 from the water container 202 to produce ice. The ice produced by the ice maker 206 is dispensed through ice dispensing point or nozzle corresponding to the ice dispensing unit 112. The ice can be dispensed in any number of the following forms of bullet ice, crescent ice, crushed ice, cubed ice, half-cubed ice, nugget ice, block ice, spherical ice and top hat ice.

A heating unit 208 is integrated in the hydration station 100 that is used to heat water received through the conduit 204 and to supply the user with heated water and hot beverages (e.g., coffee) or other purposes. The heating unit 208 comprises a heating element such as an inline heating element configured for heating water to a predetermined temperature. The temperature can be set during the manufacturing and designing of the hydration station 100. In alternative embodiments, the hydration station 100 can include an interface that allows the operator to set a desired temperature. The heating unit 208 is connected to a beverage maker unit 210 to use the heated water of the heating unit 208 to produce a hot beverage.

A soft ice unit 212 is connected by the conduit 204 to the water container 202 and is used to produce soft ice and dispense that soft ice through the soft ice dispenser 106. The soft ice unit 212 can have ingredients such as flavoring syrups or milk powder to produce soft ice, or may be comprised of only filtered water. The soft ice unit 212 can be connected to a separate refrigeration unit 214 to freeze the contents of the soft ice unit 212 to produce frozen soft ice. For producing soft ice, the milk product used can be a natural milk product such as milk or cream, or an artificial milk product. In this embodiment, each milk product is a powdered milk product. For producing soft ice, the flavoring syrups can be combined with the soft ice prior to being dispensed or may be poured over the soft ice by way of an additional dispenser. It should be noted that each unit or module 206, 208, 210, 212, and 214 is internally connected to one or more dispensing nozzles or units 201 to dispense the heated water, non-heated water, beverages and ice.

In one embodiment of the present invention, the water container 202 may be replaced with a new container or a water line may be connected to the water container 202 for a regular supply of water. It should be noted that the hydration station 100 can be designed to include any additional units to produce different types of cold and hot beverages as per the preferences of the user. The water unit is bottom loading with the water passed through the conduit 204.

Each unit or module 206, 208, 210, 212, 214 can store a certain quantity of respective drink or beverage to instantly dispense when requested by a user. The hydration station 100 is operational by using the power supplied by a regular power supply or alternatively through inbuilt rechargeable batteries.

Figure 3:
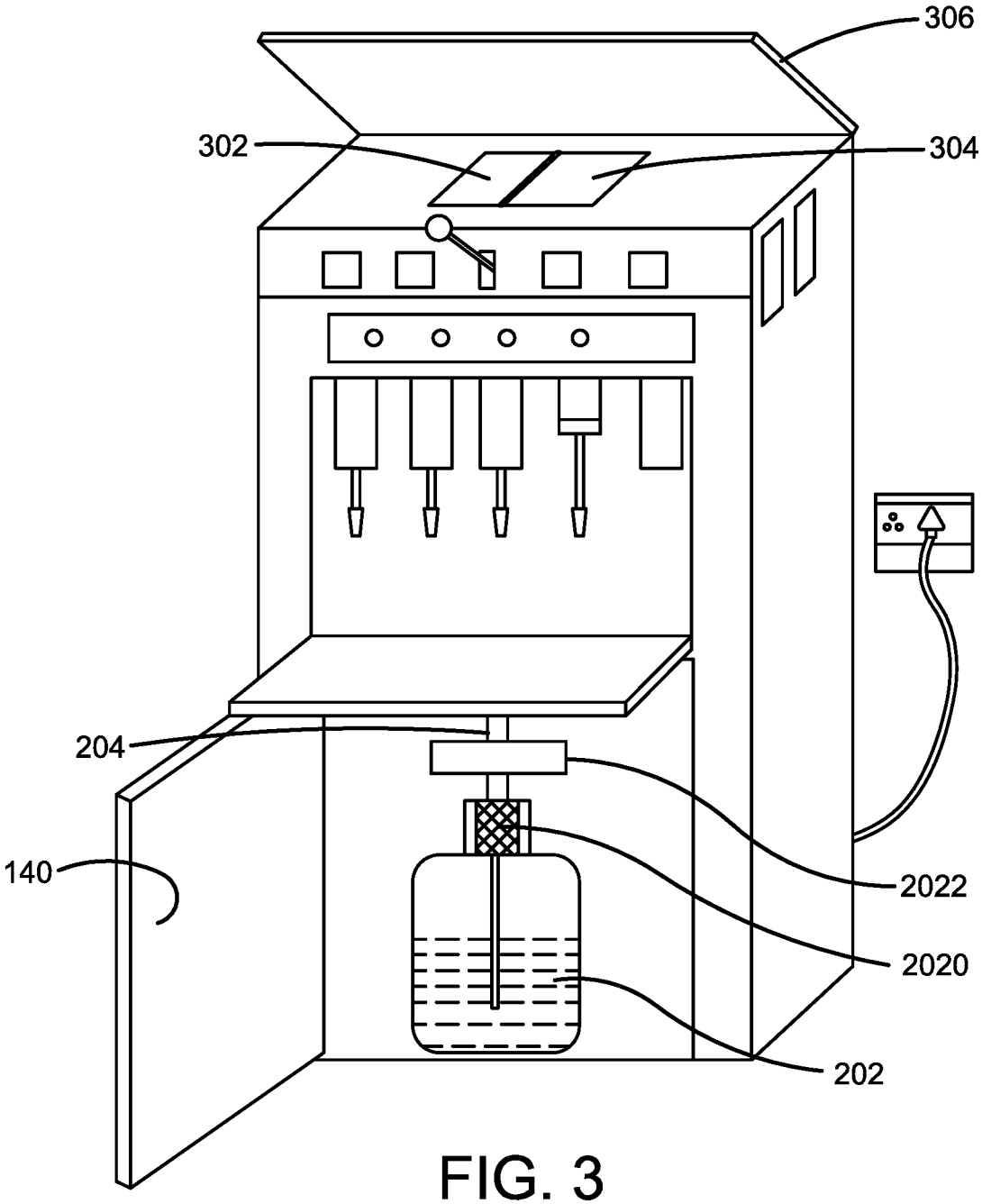
FIG. 3 illustrates a perspective view of one potential embodiment of the multi-purpose hydration station of the present invention in accordance with the disclosed architecture, wherein various storage areas are clearly visible.

FIG. 3 illustrates a perspective view of one potential embodiment of the multi-purpose hydration station 100 of the present invention in accordance with the disclosed architecture, wherein various storage areas are clearly visible. More specifically, in some embodiments, the hydration station 100 has a refrigeration storage area 302 that provides refrigeration for items that need to be refrigerated. These items include, but are not limited to, items such cheese, chocolates, fruits or flavorings. A separate non-refrigeration storage area 304 can storage items such as sugar pouches, tea bags or coffee powder. The storage areas 302, 304 are present towards the top of the hydration station 100 and can be accessed by opening the lid 306 of the hydration station 100.

A water container 202 is accessible to a user by opening a hinged panel of the bottom section 140. The water from the water container 202 moves upwards through the suction pump 2020 and is filtered using the filtration cartridge 2022. The filtered water is further supplied to the conduit 204 which is fluidly connected to different units of the hydration station 100. When a user requests any beverage, water is moved from the water container 202 through the conduit 204 and further through the units of modules described in FIG. 2 to provide the desired beverage, soft ice or ice to the user.

Figure 4:
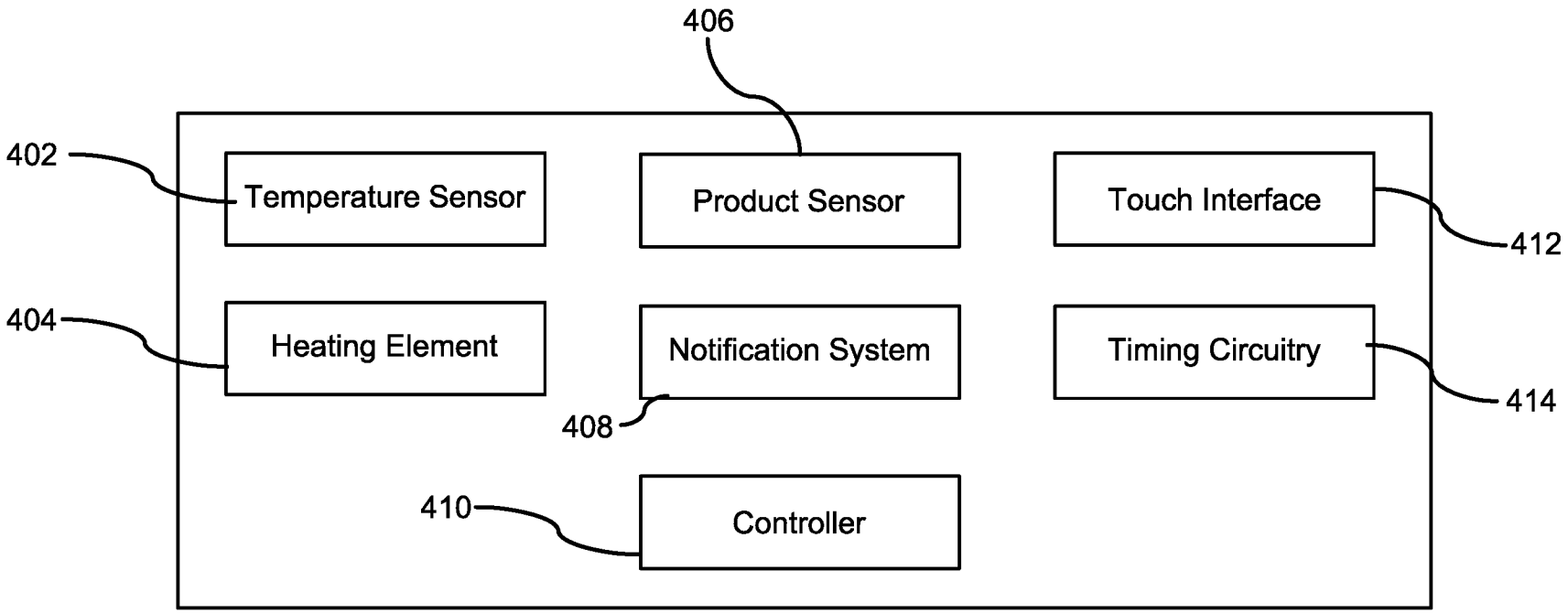
FIG. 4 illustrates a block diagram showing the various electronic components required for operation for one potential embodiment of the multi-purpose hydration station of the present invention in accordance with the disclosed architecture.

FIG. 4 illustrates a block diagram showing electronic components required for operation for one potential embodiment of the multi-purpose hydration station 100 of the present invention in accordance with the disclosed architecture. More specifically, a temperature sensor 402 is present to monitor the temperature of the heating unit and the refrigeration unit of the hydration station 100. The temperature sensor 402 may cut off the heating or cooling when a predetermined temperature is achieved. An electronic heating element 404 is used to enable heating of the water received from the water container 202. The heating element 404 can be an inducting heating element.

A product sensor 406 is mounted within the hydration station 100. As an example, the product sensor 406 may sense a weight or volume of product in any of the units or storage. The product sensor 406 can relay information about the amount of product left in respective units. The LEDs of the corresponding nozzle or dispensing unit can be connected to the product sensor 406 to indicate the remaining amount of the product. A notification system 408, connecting the LEDs and the product sensor 406, allows the LEDs to flash to indicate a status.

In one embodiment of the present invention, a wireless transmitter may be connected to the product sensor 406 allowing the hydration station 100 to send a notification to an operator or housekeeping staff member to notify them of the amount of the product remaining in the modules or units. The product sensor 406 can also be used for notifying about the level of water in the water container of the hydration station 100.

A central controller 410 is present to control operations of the individual electronic components of the hydration station 100. The controller 410 sends instructions to the individual components for monitoring and controlling their operations. The controller 410 may comprise suitable hardware, software or control logic that allows the controller 410 to receive input signals, process those signals and send output signals to the electronic components.

A touch interface 412 is one embodiment of the selection interface and can be present to allow a user to input a request for a beverage through a touch button present on the surface of the hydration station 100. The controller 410 receives the input from the touch interface 412 and accordingly instructs the appropriate unit or module to produce the requested beverage or drink and dispense it through the nozzle.

A timing circuitry 414 present in the hydration station 100 can allow a unit or module to operate for a predetermined amount of time. The timing circuit 414 can also allow the hydration station 100 to dispense a limited amount of drink or beverage from the dispensing units or nozzles. In some embodiments of the present invention, the hydration station 100 has a sensor to detect the presence of a cup or tumbler on the compartment. When the cup or tumbler is not detected, the dispensing units for water, beverage or any other liquid or ice are disabled.

In some embodiments of the present invention, the hydration station 100 has feet members attached to the bottom of the hydration station 100. The feet members can serve the purposes of making the hydration station 100 easily moveable, lifting the bottom of the hydration station off the surface on which it is located, thereby preventing damage to that surface or to the hydration station, and similar such purposes. These feet members can be appendages such as wheels, lockable wheels, rubber legs, plastic legs or similar suited members that serve the desired purpose.

Certain terms are used throughout the following description and claims to refer to particular features or components. As one skilled in the art will appreciate, different persons may refer to the same feature or component by different names. This document does not intend to distinguish between components or features that differ in name but not structure or function. As used herein "multi-purpose hydration station", "multi-functional hydration station", "hydration station", "station", "hydration unit", "dispensing device" and "multi-purpose beverage dispenser", are interchangeable and refer to the multi-purpose hydration station 100 of the present invention.

Notwithstanding the forgoing, the multi-purpose hydration station 100 of the present invention can be of any suitable size and configuration as known in the art without affecting the overall concept of the invention, provided that it accomplishes the above-stated objectives. One of ordinary skill in the art will appreciate that the size, configuration and material of the multi-purpose hydration station 100 as shown in the FIGS. are for illustrative purposes only and that many other sizes and shapes of the multi-purpose hydration station 100 are well within the scope of the present disclosure. Although the dimensions of the multi-purpose hydration station are important design parameters for user convenience, the multi-purpose hydration station may be of any size that ensures optimal performance during use or that suits the user's needs or preferences.

Various modifications and additions can be made to the exemplary embodiments discussed without departing from the scope of the present invention. While the embodiments described above refer to particular features, the scope of this invention also includes embodiments having different combinations of features and embodiments that do not include all of the described features. Accordingly, the scope of the present invention is intended to embrace all such alternatives, modifications and variations as they fall within the scope of the claims, together with all equivalents thereof.

What has been described above includes examples of the claimed subject matter. It is, of course, not possible to describe every conceivable combination of components or methodologies for purposes of describing the claimed subject matter, but one of ordinary skill in the art will recognize that many further combinations and permutations of the claimed subject matter are possible. Accordingly, the claimed subject matter is intended to embrace all such alterations, modifications and variations that fall within the spirit and scope of the claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A hydration station comprising:
a housing;
a water supply;
a heating unit;
a refrigeration unit;
an ice maker configured to generate a bullet ice, a crescent ice, a crushed ice, a cubed ice, a half-cubed ice, a nugget ice, a block ice, a spherical ice, and a top hat ice;
a filter;
a beverage making unit;
a plurality of dispensers; and
a control panel having a selection interface.

2. The hydration station of claim 1, wherein the water supply is in fluid communication with each of the heating unit, the refrigeration unit, the ice maker, the filter and the beverage making unit.

3. The hydration station of claim 1, wherein the plurality of dispensers comprise at least two of a non-heated water dispenser, a heated water dispenser, a soft ice dispenser, a beverage dispenser, and an ice dispenser.

4. The hydration station of claim 1, wherein the selection interface comprises at least two of a non-heater water control button, a heated water control button, a beverage control button, and an ice control button.

5. The hydration station of claim 1 further comprising a plurality of LEDs.

6. The hydration station of claim 5, wherein the plurality of LEDs comprise at least two of a non-heated water LED, a heater water LED, a soft ice LED, a beverage LED and an ice LED.

7. The hydration station of claim 6 further comprising a controller.

8. The hydration station of claim 7 further comprising a timing circuitry.

9. The hydration station of claim 8 further comprising a pump.

10. The hydration station of claim 9 further comprising a temperature sensor.

11. The hydration station of claim 9 further comprising a notification system.

12. A hydration station comprising:
a housing having a hinged door repositionable between an open position and a closed position;
a water supply;
a supply of beverage flavorings stored within said housing;
a heating unit;
a refrigeration unit;
an ice maker stored within said housing and in fluid communication with said water supply;
a beverage making unit stored within said housing and in fluid communication with said water supply;
a plurality of dispensers positioned on an exterior of the housing, the plurality of dispensers comprising a non-heated water dispenser, a heated water dispenser, a soft ice dispenser, a beverage dispenser, and an ice dispenser; and
a selection interface comprised of a non-heater water control button, a heated water control button, a beverage control button, and an ice control button; and
a product sensor configured to send a wireless notification of a status of an amount of the supply of beverage flavorings remaining and a level of water remaining in the water supply; and
wherein the soft ice dispenser is configured to generate a frozen beverage by mixing a soft ice with the supply of beverage flavorings prior to dispensing.

13. The hydration station of claim 1 further comprising a non-heated water LED, a heater water LED, a soft ice LED, a beverage LED and an ice LED.

14. The hydration station of claim 13 further comprising a controller, a timing circuitry, and a pump.

15. The hydration station of claim 14 further comprising a temperature sensor.

16. The hydration station of claim 15, wherein the housing further comprises at least one compartment that is cooled using a separate refrigeration unit.

17. The hydration station of claim 16 further comprising at least one filter for filtering wherein the housing further comprises at least one compartment that is cooled using a separate refrigeration unit.

18. A hydration station comprising:

a housing having an interior and an exterior;

a water supply positioned within the interior;

a supply of beverage flavorings;

a heating unit positioned within the interior;

a refrigeration unit positioned within the interior;

a non-refrigeration storage area positioned within the interior accessible by opening a lid of the housing;

an ice maker in fluid communication with said water supply, the ice maker configured to generate a bullet ice, a crescent ice, a crushed ice, a cubed ice, a half-cubed ice, a nugget ice, a block ice, a spherical ice, and a top hat ice;

a beverage making unit in fluid communication with said water supply;

a pump;

a plurality of dispensers positioned on the exterior of the housing;

at least one refrigerated storage space positioned within the interior; and a selection interface comprised of a non-heater water control button, a heated water control button, a beverage control button, and an ice control button; and wherein the ice maker is configured to generate a frozen beverage by mixing the crushed ice with the supply of beverage flavorings prior to dispensing.

* * * * *